US007815102B2

(12) United States Patent
Lee

(10) Patent No.: US 7,815,102 B2
(45) Date of Patent: Oct. 19, 2010

(54) INPUTTING DEVICE FOR REFRIGERATOR

(75) Inventor: Ik-Kyu Lee, Gyeongsangnam-Do (KR)

(73) Assignee: LG Electronics Inc., Seoul (KR)

( * ) Notice: Subject to any disclaimer, the term of this patent is extended or adjusted under 35 U.S.C. 154(b) by 550 days.

(21) Appl. No.: 11/773,183

(22) Filed: Jul. 3, 2007

(65) Prior Publication Data

US 2008/0007520 A1 Jan. 10, 2008

(30) Foreign Application Priority Data

Jul. 5, 2006 (KR) ..... 10-2006-0063145

(51) Int. Cl.
*G06F 17/00* (2006.01)

(52) U.S. Cl. ..... 235/375

(58) Field of Classification Search ..... 235/375
See application file for complete search history.

(56) References Cited

U.S. PATENT DOCUMENTS 4,615,179 A 10/1986 Chiu et al.
5,230,467 A 7/1993 Kubsch et al.
6,170,273 B1 * 1/2001 Bosi ..... 340/547
6,993,485 B2 1/2006 Ferragut, II et al.
7,376,909 B1 * 5/2008 Coyle ..... 715/778
2004/0066379 A1 * 4/2004 Ise et al. ..... 345/175
2005/0010315 A1 * 1/2005 Silverman ..... 700/94
2005/0258954 A1 * 11/2005 Ruskin ..... 340/527
2006/0060867 A1 3/2006 Suehiro
2006/0164387 A1 * 7/2006 Takisima ..... 345/156

* cited by examiner

*Primary Examiner*—Thien Minh Le
*Assistant Examiner*—Christle I Marshall
(74) *Attorney, Agent, or Firm*—Birch, Stewart, Kolasch & Birch, LLP

(57) ABSTRACT

An inputting device for a refrigerator, comprises: a display having one or more button regions; and an optical sensor for sensing the button region selected by a user according to whether optical signals have been shielded; and a controller for receiving a signal indicating the sensed state from the optical sensor thereby controlling an operation of a refrigerator. Since the optical sensor for sensing the button region selected by a user is provided, an operation error is reduced. Furthermore, since the optical sensor has a low cost, a fabrication cost is reduced.

12 Claims, 4 Drawing Sheets

INPUTTING DEVICE FOR REFRIGERATOR

RELATED APPLICATION

The present disclosure relates to subject matter contained in priority Korean Application No. 2006-0063145, filed on Jul. 5, 2006, which is herein expressly incorporated by reference in its entirety.

BACKGROUND OF THE INVENTION

1. Field of the Invention

The present disclosure relates to a refrigerator, and more particularly, to an inputting device for a refrigerator capable of inputting a control command by a user so as to control an operation of a refrigerator by using an optical sensor.

2. Description of the Background Art

Generally, a refrigerator serves to keep food items with a fresh state for a long time. The refrigerator is largely divided into a freezing chamber for keeping frozen food items, a cooling chamber for keeping refrigerating food items, and a refrigerating cycle for cooling the freezing chamber and the cooling chamber. An operation of the refrigerator is controlled by a controller mounted in the refrigerator.

In order to properly maintain each temperature of the freezing chamber and the cooling chamber, a control panel having a plurality of buttons so as to select a temperature of the freezing chamber or the cooling chamber is installed at a door.

The control panel has a printed circuit board (PCB) for controlling each operation of components according to an external signal in a casing concavely formed at the door, control buttons connected to the PCB and disposed at a front surface of the door, and a display window for displaying a state of the refrigerator according to a selected control button.

A plurality of functions that can be selected by a user such as power freezing, power cooling, a temperature level for a cooling chamber, a temperature level for a freezing chamber, a door check, deodorization, etc. are displayed on the display window. Herein, each of the functions may be selected by the control button on the control panel.

As the control panel having a plurality of buttons, a touch screen for inputting commands by a user's touch, or an electrostatic induction switch may be used.

According to the conventional touch screen for a refrigerator, a user can input a menu selected on an LCD screen. However, the conventional touch screen has a disadvantage of a high cost.

According to the conventional electrostatic induction switch, a user can not select a menu on an LCD screen, and an input error may be caused due to moisture.

SUMMARY OF THE INVENTION

Therefore, an object of the present disclosure is to provide an inputting device for a refrigerator capable of inputting a selected menu on a display of a refrigerator, reducing a fabrication cost, and preventing an operation error caused by a state change inside and outside the refrigerator.

To achieve these and other advantages and in accordance with the purpose of the present disclosure, as embodied and broadly described herein, there is provided an inputting device for a refrigerator, comprising: a display having one or more button regions; and an optical sensor for sensing the button region selected by a user, and transmitting a signal indicating the sensed state to a controller.

The display may comprise a displaying unit for displaying the button region selected by the user.

The button region may comprise a button having a through hole for selectively passing optical signals; and a supporting unit for elastically supporting the button in a longitudinal direction.

The inputting device for a refrigerator may further comprise a power supply button for supplying power to the optical sensor.

Power may be supplied to the optical sensor according to an external signal inputted to the button region.

The optical sensor may comprise one or more light emitting units for emitting optical signals; one or more light receiving units facing the light emitting units, for receiving the optical signals; and a detecting unit for detecting whether the optical signals have been shielded or a shielded position of the optical signals.

The light emitting units may be disposed so that optical signals emitted therefrom may be selectively shielded by the button regions.

The light emitting units may be disposed so that optical signals emitted therefrom may be crossed to each other.

The light emitting units may be provided at an edge of the display.

The button region may be disposed at an intersection between the optical signals emitted from the light emitting units.

The light emitting unit and the light receiving unit may further comprise waterproofing units.

The waterproofing units may be implemented as waterproofing film molded on the light emitting unit and the light receiving unit.

The waterproofing units may be also implemented as waterproofing covers disposed on the light emitting unit and the light receiving unit.

The detecting unit may recognize intersects of the optical signals as each coordinate, and may transmit a coordinate where the optical signal is shielded to the controller.

The foregoing and other objects, features, aspects and advantages of the present disclosure will become more apparent from the following detailed description of the present disclosure when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Reference will now be made in detail to the preferred embodiments of the present disclosure, examples of which are illustrated in the accompanying drawings.

Figure 1:
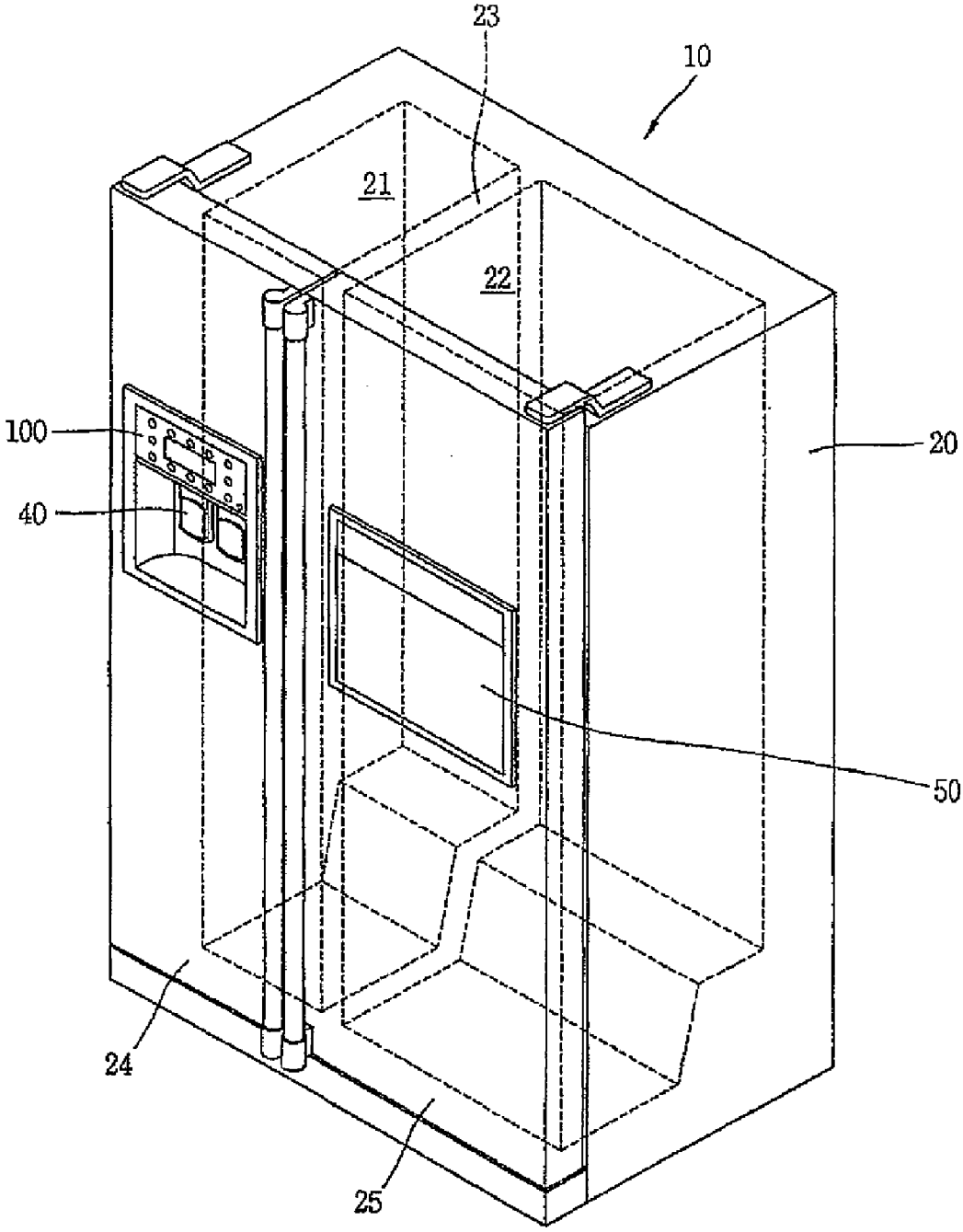
FIG. 1 is a frontal view showing a side by side-type refrigerator to which an inputting device for a refrigerator according to the present invention may be applied.

FIG. 1 is a frontal view showing a side by side-type refrigerator to which an inputting device for a refrigerator according to the present invention may be applied. A side by side-type refrigerator was applied to the present invention. However, various kinds of refrigerators may be applied to the present invention.

Referring to FIG. 1, a side by side-type refrigerator 10 comprises a freezing chamber 21 and a cooling chamber 22 separated from each other by a partition wall 23 vertically disposed at a central portion; and a freezing chamber door 24 and a cooling chamber door 25 hinge-coupled to a body 20 of the refrigerator, respectively, for opening and closing the freezing chamber 21 and the cooling chamber 22.

The side by side-type refrigerator 10 is provided with a refrigerating cycle composed of a compressor, a condenser, a capillary tube or an electronic expansion valve, and an evaporator; and a cool air circulating fan for supplying cool air heat-exchanged at the evaporator to the freezing chamber or the cooling chamber.

An inputting device 100 for a refrigerator according to a first embodiment of the present invention is installed on the freezing chamber door 24 or the cooling chamber door 25 so as to control an operation of the refrigerator by a user and displaying a state of the refrigerator.

A dispenser 40 for containing ice cube or cool water may be disposed on the freezing chamber door 24, and a home bar 50 for taking out beverage, etc. may be provided on the cooling chamber door 25. The inputting device 100 may be disposed above or below the dispenser 40 or the home bar 50. The inputting device 100 may be provided on the home bar 50.

A position of the dispenser 40 or the home bar 50 is determined according to a user's body condition such as a user's height for convenience. Also, a position of the inputting device 100 for a refrigerator according to the first embodiment of the present invention is determined according to a user's convenient condition.

Figure 2:
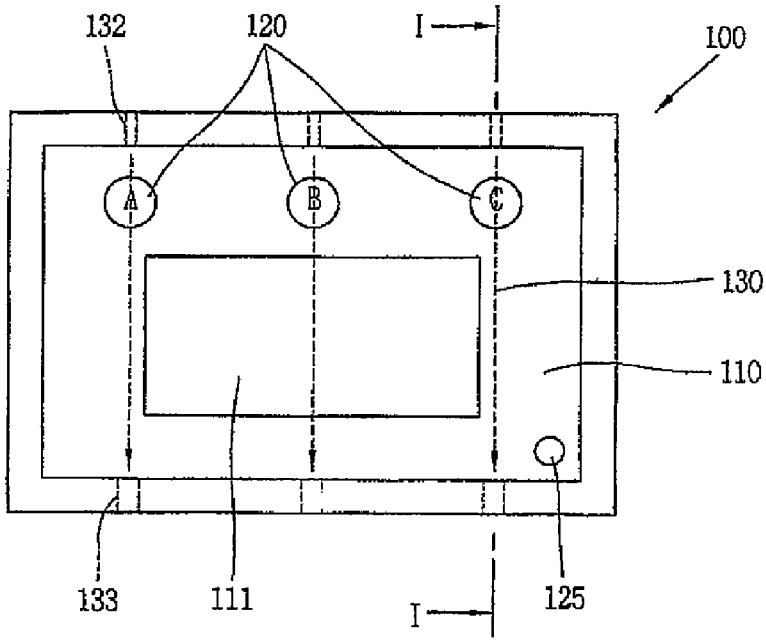
FIG. 2 is a frontal view showing an inputting device for a refrigerator according to a first embodiment of the present invention.

FIG. 2 is a frontal view showing an inputting device for a refrigerator according to a first embodiment of the present invention.

Referring to FIG. 2, the inputting device 100 for a refrigerator according to the first embodiment of the present invention comprises: a display 110 having one or more button regions 120; and an optical sensor 130 for sensing the button region 120 selected by a user according to whether optical signals are shielded, and transmitting a signal indicating the sensed state to a controller (not shown).

The display 110 may be implemented as a thin LCD monitor, and is provided with the button regions 120 for receiving an input signal by a user. An operation parameter of the refrigerator controlled by the button region 120 may be displayed at a peripheral portion of the button region 120. The operation parameter may be electrically displayed on the display 110, or may be printed on the display 110.

The display 110 may comprise a displaying unit 111 for displaying a signal inputted to the button region 120 by a user, or an operation state of the refrigerator (a freezing chamber temperature, a cooling chamber temperature, etc.).

The user selects a corresponding button region 120 according to a signal displayed on the displaying unit 111 or a signal printed on the button region 120, thereby selecting an item such as a menu, a freezing/cooling intensity, and a temperature level.

The button region will be explained in more detail with reference to FIG. 3.

Figure 3:
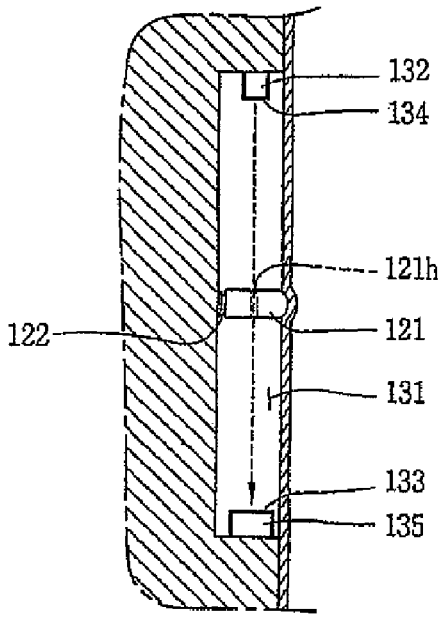
FIG. 3 is a sectional view taken along line 'I-I' of FIG. 2.

FIG. 3 is a sectional view taken along line 'I-I' of FIG. 2.

Referring to FIG. 3, a receiving space 131 for receiving the optical sensor 130 is disposed at a rear surface of the display 110. The optical sensor 130 comprises one or more light emitting units 132 for emitting optical signals; one or more light receiving units 133 having the same number as the light emitting units 132, for receiving the optical signals; and a detecting unit 140 for detecting whether the optical signals have been shielded between the light emitting units 132 and the light receiving units 133, and transmitting a signal indicating the detected state to a controller (not shown) inside the refrigerator.

The button region 120 of the display 110 may comprise a button 121 having a through hole **121*h* for selectively passing optical signals; and a supporting unit 122 for elastically supporting the button 121 in a longitudinal direction. The button 121 may be formed of an elastic material so as to be restored to the original state even when the button region 120** is pressed.

The light emitting units 132 and the light receiving units 133 are implemented as a light emitting diode or an infrared rays lamp/sensor, and disposed at upper and lower sides in the receiving space 131 provided at a rear surface of the display 110. The light emitting units 132 and the light receiving units 133 are disposed to be spaced from an inner wall of the receiving space by 3~5 mm, and prevent optical signals from being shielded by pressing the button region 120 by a user.

Optical signals may be transmitted between the light emitting units 132 and the light receiving units 133. Herein, a power supply button 125 for applying power to the light emitting units 132 and the light receiving units 133 may be provided. The optical sensor 130 is operated by the power apply button 125, thereby preventing power waste. One of the button regions 120 may be used as the power supply button 125, thereby reducing a fabrication cost.

The light emitting unit 132 and the light receiving unit 133 are provided with waterproofing units 134 and 135 formed of a waterproofing material for transmitting only light not moisture so as to prevent an operation error due to moisture. The waterproofing units 134 and 135 may be implemented as waterproofing films molded on the light emitting unit 132 and the light receiving unit 133. The waterproofing units 134 and 135 may be also implemented as waterproofing covers disposed on the light emitting unit 132 and the light receiving unit 134.

The detecting unit 140 is connected to the light emitting unit 132 and the light receiving unit 133, and detects whether the optical signals emitted from the light emitting units 132 have been received by the light receiving units 133. Then, the detecting unit 140 transmits a signal indicating the detected state to the controller C of FIG. 4.

Hereinafter, an operation of the inputting device for a refrigerator according to the first embodiment of the present invention will be explained with reference to FIG. 4.

Figure 4:
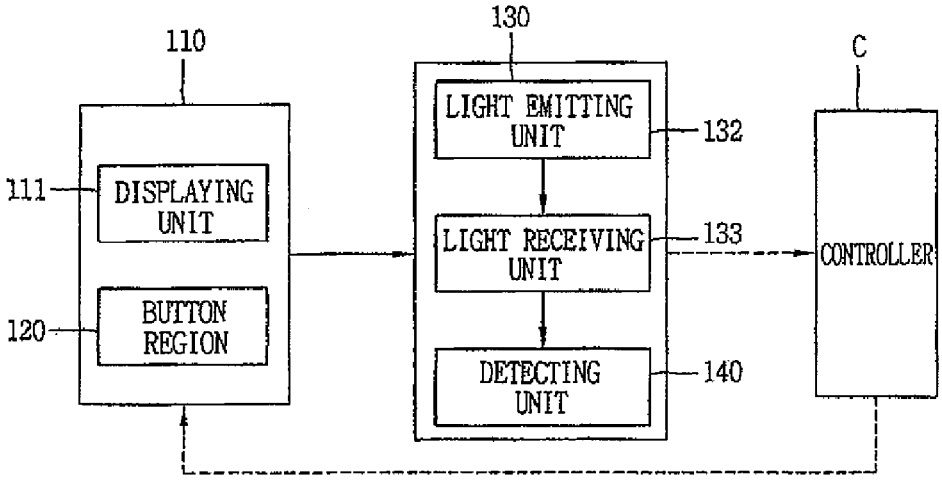
FIG. 4 is a block diagram showing the inputting device for a refrigerator according to a first embodiment of the present invention.

FIG. 4 is a block diagram showing the inputting device for a refrigerator according to a first embodiment of the present invention.

When the power supply button 125 of FIG. 3 is pressed by a user, power is supplied to the optical sensor 140 and thus optical signals are transmitted to the light receiving units 133 from the light emitting units 132. Herein, when the button region 120 is pressed by a user, optical signals that pass through the button region 120 are shielded. An operation parameter of the refrigerator controlled by the button region 120 may be electrically displayed on the displaying unit 111, or may be printed on the button region 120 thus to be selected by a user.

While optical signals are generated from the light emitting units 132, the detecting unit 140 detects the light receiving unit 133 having not received the optical signals, and transmits a signal indicating the detected state to the controller C.

Then, the controller C controls an operation of each component according to the signal, and displays an operation state of the refrigerator with respect to an operation parameter selected by the user on the displaying unit 111.

An operation of an inputting device for a refrigerator according to a second embodiment of the present invention will be explained with reference to FIG. 5.

Figure 5:
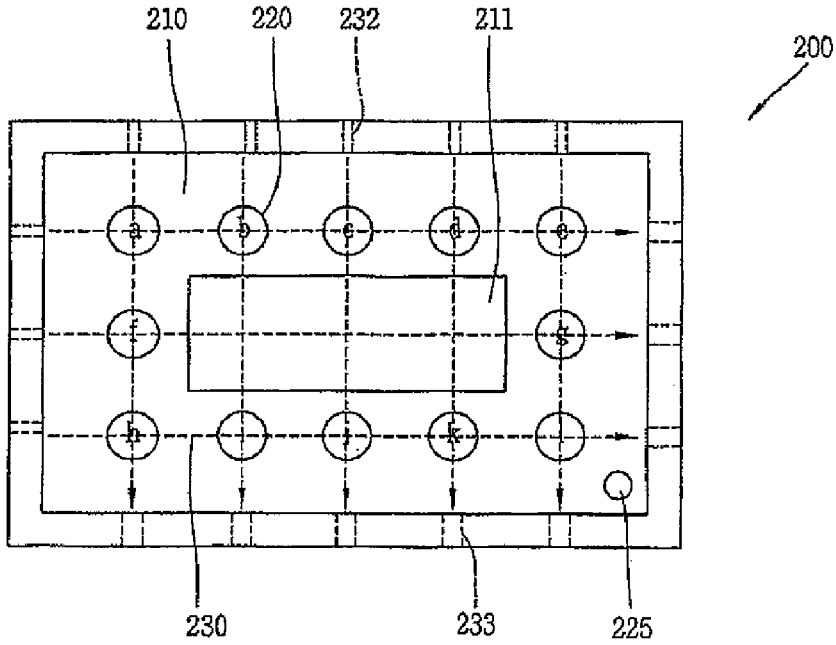
FIG. 5 is a frontal view showing an optical sensor of an inputting device for a refrigerator according to a second embodiment of the present invention.
Figure 6:
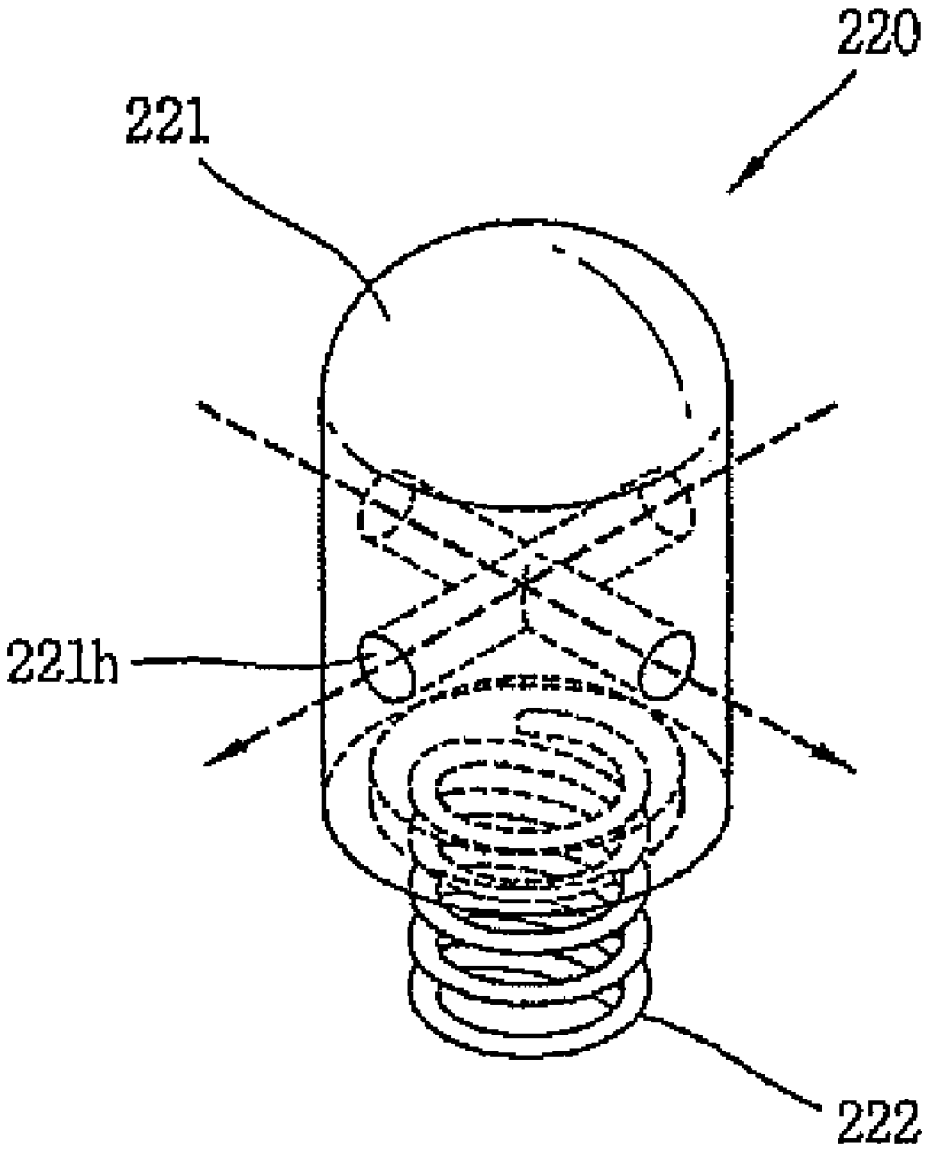
FIG. 6 is a perspective view showing a button region of FIG. 5.

FIG. 5 is a frontal view showing an optical sensor of an inputting device for a refrigerator according to a second embodiment of the present invention, and FIG. 6 is a perspective view showing button regions of FIG. 5.

Referring to FIGS. 5 and 6, an inputting device 200 for a refrigerator according to a second embodiment of the present invention comprises a plurality of light emitting units 232, and a plurality of light receiving units 233 facing the light emitting units 232 and receiving optical signals emitted from the light emitting units 232. Herein, the light emitting units 232 are disposed so that optical signals emitted therefrom can be crossed to each other.

More concretely, the light emitting units 232 and the light receiving units 233 are disposed at an edge of the display 210 so that linear optical signals can be crossed to each other between the light emitting units 232 and the light receiving units 233. In FIG. 5, the optical signals emitted from the light emitting units 232 are vertically crossed to each other. However, the light emitting units may be installed at various portions such as a circular edge of the display 210.

In the inputting device 200 for a refrigerator according to the second embodiment of the present invention, a button region 220 is positioned at an intersect of the optical signals. A button 221 of the button region 220 has a through hole 221*h* for passing two optical signals. The button 221 is elastically supported by a supporting unit 222 in a longitudinal direction. The button 221 may be formed of an elastic material so as to be restored to the original state even when the button region 220 is pressed.

The detecting unit 140 is connected to the light emitting units 232 and the light receiving units 233, and detects whether the optical signals emitted from the light emitting units 232 have been received by the light receiving units 233. Then, the detecting unit 140 detects a shielded position of the optical signals, and transmits a signal indicating the detected state to the controller C of FIG. 4.

The detecting unit 140 may recognize an intersect of two optical signals as a coordinate, and may transmit a signal for selecting a menu, a freezing/cooling intensity, a temperature level, etc. displayed on the displaying unit 211 to the controller C. Then, the controller C controls an operation of each component according to the signal.

Preferably, the detecting unit 140 is implemented as a circuit for detecting a coordinate formed at an intersect of two optical signals between the light emitting units 232 and the light receiving units 233, and detecting a signal or a command corresponding to the coordinate.

The optical sensor 20 is provided at a periphery of the display, thereby serving as a button or a touch screen.

An operation of the inputting device for a refrigerator according to the second embodiment of the present invention will be explained with reference to FIG. 6.

When the power supply button 225 is pressed by a user, power is supplied to the light emitting units 232 and the light receiving units 233, and thus optical signals are transmitted from the light emitting units 232 to the light receiving units 233. Herein, when the button region 220 is pressed by a user, optical signals intersecting each other at the button region 220 are shielded.

While optical signals are generated from the light emitting units 232, the detecting unit 140 detects the light receiving units 233 having not received the optical signals. The detecting unit 140 detects a coordinate where the optical signals have been shielded based on two light receiving units 233 having not received the optical signals, and transmits a signal indicating the detected state to the controller C.

Then, the controller C controls an operation of each component according to the signal, and displays an operation state of the refrigerator with respect to an operation parameter selected by the user on the displaying unit 211.

The inputting device for a refrigerator according to the present invention has the optical sensor composed of the light emitting unit, the light receiving unit, and the detecting unit, thereby sensing the button region selected by a user according to whether the optical signals are shielded. Accordingly, a fabrication cost is low, and a productivity is enhanced.

Furthermore, since the button region is provided at an intersect of optical signals between the light emitting units and the light receiving units, the optical sensor detects the button region selected by a user according to whether optical signals are shielded. Accordingly, a button input is correctly implemented. Also, the light emitting units and the light receiving units are provided with the waterproofing unit for passing only optical signals not moisture, respectively. Accordingly, an operation error due to moisture is prevented, and an operation reliability is enhanced.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A refrigerator, comprising:

a freezing chamber including a freezing chamber door, and for keeping frozen food items;

a cooling chamber including a cooling chamber door, and for keeping refrigerated food items;

a controller for controlling an operation of the refrigerator; and an input device installed on the freezing chamber door or the cooling chamber door, and for inputting a control command which controls the operation of the refrigerator, and displaying a state of the refrigerator, wherein the input device comprises:

a display having one or more button regions;

an optical sensor for sensing the button region selected by a user according to whether optical signals are shielded, and transmitting a signal indicating the sensed state to the controller; and a power supply button for supplying power to the optical sensor, and wherein the button region comprises:

a button having a through hole for selectively passing an optical signal; and a supporting unit for elastically supporting the button in a longitudinal direction.

2. The refrigerator of claim 1, wherein the display comprises a displaying unit for displaying the button region selected by the user.

3. The refrigerator of claim 1, wherein the optical sensor comprises:

one or more light emitting units for emitting optical signals;

one or more light receiving units facing the light emitting units, for receiving the optical signals; and a detecting unit for detecting whether the optical signals have been shielded or a shielded position of the optical signals.

4. The refrigerator of claim 3, wherein the optical signals emitted from the light emitting units are selectively shielded by the button regions.

5. The refrigerator of claim 3, wherein the light emitting units are disposed so that optical signals emitted therefrom may be crossed to each other.

6. The refrigerator of claim 5, wherein the light emitting units are provided at an edge of the display.

7. The refrigerator of claim 5, wherein the button region is disposed at an intersection between the optical signals emitted from the light emitting units.

8. The refrigerator of claim 5, wherein the detecting unit recognizes intersects of the optical signals as each coordinate, and transmits a coordinate where the optical signal is shielded to the controller.

9. The refrigerator of claim 3, wherein the light emitting unit and the light receiving unit further comprise waterproofing units.

10. The refrigerator of claim 9, wherein the waterproofing units are implemented as waterproofing films molded on the light emitting unit and the light receiving unit.

11. The refrigerator of claim 9, wherein the waterproofing units are implemented as waterproofing covers disposed on the light emitting unit and the light receiving unit.

12. The refrigerator of claim 1, wherein power is supplied to the optical sensor according to an external signal inputted to the button region.

* * * * *